US008640979B2

(12) United States Patent
Wu

(10) Patent No.: US 8,640,979 B2
(45) Date of Patent: Feb. 4, 2014

(54) SPRAYER HAVING WATER-TIGHT FUNCTION

(75) Inventor: Jui-Chang Wu, Fu Hsing Township, Changhua County (TW)

(73) Assignee: SK & Y Agricultural Equipments Co., Ltd., Fu Hsing Township (TW)

( * ) Notice: Subject to any disclaimer, the term of this patent is extended or adjusted under 35 U.S.C. 154(b) by 265 days.

(21) Appl. No.: 13/221,991

(22) Filed: Aug. 31, 2011

(65) Prior Publication Data

US 2013/0048757 A1 Feb. 28, 2013

(51) Int. Cl.
*B05B 15/06* (2006.01)

(52) U.S. Cl.
USPC ..... 239/532; 239/526

(58) Field of Classification Search
USPC ..... 239/532, 525, 526, 589, 590, 600
See application file for complete search history.

(56) References Cited

U.S. PATENT DOCUMENTS

| | | | | |
|---|---|---|---|---|
| 4,982,896 | A * | 1/1991 | Crow | 239/11 |
| 6,220,527 | B1 * | 4/2001 | Chen et al. | 239/532 |
| 6,976,644 | B2 * | 12/2005 | Troudt | 239/587.1 |
| 2008/0251610 | A1 * | 10/2008 | Franks | 239/433 |
| 2011/0072956 | A1 * | 3/2011 | Wall | 89/1.11 |

* cited by examiner

*Primary Examiner* — Davis Hwu
(74) *Attorney, Agent, or Firm* — Alan Kamrath; Kamrath IP Lawfirm, P.A.

(57) ABSTRACT

A sprayer includes a shank having a first end provided with a first connecting portion and a second end provided with a second connecting portion, a first connector secured on the first connecting portion of the shank, a first water-tight gasket abutting the first connecting portion and the first connector, a second connector secured on the second connecting portion of the shank, a second water-tight gasket abutting the second connecting portion and the second connector, a handle connected with the first connector, and a nozzle assembly connected with the second connector. Thus, the liquid will not leak between the first connector and the first connecting portion of the shank by the first water-tight gasket and will not leak between the second connector and the second connecting portion of the shank by the second water-tight gasket.

9 Claims, 9 Drawing Sheets

SPRAYER HAVING WATER-TIGHT FUNCTION

BACKGROUND OF THE INVENTION

1. Field of the Invention

The present invention relates to a gardening tool and, more particularly, to a tank sprayer for a gardening purpose.

2. Description of the Related Art

A conventional sprayer in accordance with the prior art shown in FIGS. 8-13 comprises a shank 60 having a first end provided with a first connecting portion 601 and a second end provided with a second connecting portion 602, a first connector 61 mounted on the first connecting portion 601 of the shank 60, a second connector 62 mounted on the second connecting portion 602 of the shank 60, a handle 50 connected with the first connector 61 by a threaded fastening member 612, and a nozzle assembly 70 connected with the second connector 62. The handle 50 has an end provided with a threaded fitting portion 52 which has an interior provided with an opening 51. The first connector 61 has a mediate portion provided with a protruding stop flange 611. The first connector 61 has an end provided with an insertion portion 613 inserted into the opening 51 of the threaded fitting portion 52 of the handle 50. The insertion portion 613 of the first connector 61 has a distal end protruding from the first connecting portion 601 of the shank 60 and has an interior provided with a chamber 614. The fastening member 612 is screwed onto the threaded fitting portion 52 of the handle 50 and is stopped by the stop flange 611 of the first connector 61. The second connector 62 has an end provided with an external threaded portion 621 connected with the nozzle assembly 70. The external threaded portion 621 of the second connector 62 has a distal end protruding from the second connecting portion 602 of the shank 60 and has an interior provided with a receiving space 622 to receive a strainer 623. The nozzle assembly 70 is screwed onto the external threaded portion 621 of the second connector 62.

In operation, the handle 50 is connected to a container. Thus, the liquid in the container in turn flows through the handle 50 and the shank 60 into the nozzle assembly 70 and is injected outward from the nozzle assembly 70 for use with a user.

However, when the liquid flows through the chamber 614 of the insertion portion 613 of the first connector 61 into the first connecting portion 601 of the shank 60, the liquid easily leaks from a gap between the insertion portion 613 of the first connector 61 and the first connecting portion 601 of the shank 60 due to the larger pressure from the container. In addition, when the liquid flows through the second connecting portion 602 of the shank 60 into the receiving space 622 of the external threaded portion 621 of the second connector 62, the liquid easily leaks from a gap between the second connecting portion 602 of the shank 60 and the external threaded portion 621 of the second connector 62 due to the larger pressure from the container.

BRIEF SUMMARY OF THE INVENTION

In accordance with the present invention, there is provided a sprayer, comprising a shank having a first end provided with a first connecting portion and a second end provided with a second connecting portion, a first connector secured on the first connecting portion of the shank, a second connector secured on the second connecting portion of the shank, a handle connected with the first connector, and a nozzle assembly connected with the second connector.

The handle has an end provided with a threaded fitting portion which has an interior provided with an opening for mounting a first water-tight gasket. The first connector has an end provided with an insertion portion inserted into the opening of the threaded fitting portion of the handle. The insertion portion of the first connector covers and coats the first connecting portion of the shank completely. The second connector has an end provided with an external threaded portion connected with the nozzle assembly. The external threaded portion of the second connector covers and coats the second connecting portion of the shank completely. The nozzle assembly includes a mounting member having a first end provided with an internal threaded portion screwed onto the external threaded portion of the second connector and a second end provided with an outer threaded portion, a second water-tight gasket mounted in the internal threaded portion of the mounting member, and a nozzle head having an end an inner threaded portion screwed onto the outer threaded portion of the mounting member.

The primary objective of the present invention is to provide a sprayer having a water-tight function.

According to the primary advantage of the present invention, the insertion portion of the first connector covers and coats the first connecting portion of the shank completely, and the first water-tight gasket abuts the end face of the first connecting portion of the shank and the end face of the insertion portion of the first connector to provide a water-tight function so that the liquid will not leak between the insertion portion of the first connector and the first connecting portion of the shank so as to enhance the close connection between the first connector and the shank.

According to another advantage of the present invention, the external threaded portion of the second connector covers and coats the second connecting portion of the shank completely, and the second water-tight gasket abuts the end face of the second connecting portion of the shank and the end face of the external threaded portion of the second connector to provide a water-tight function so that the liquid will not leak between the external threaded portion of the second connector and the second connecting portion of the shank so as to enhance the close connection between the second connector and the shank.

According to a further advantage of the present invention, the sprayer has a water-tight function so that the sprayer will not leak during a long-term utilization and can be operated safely.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
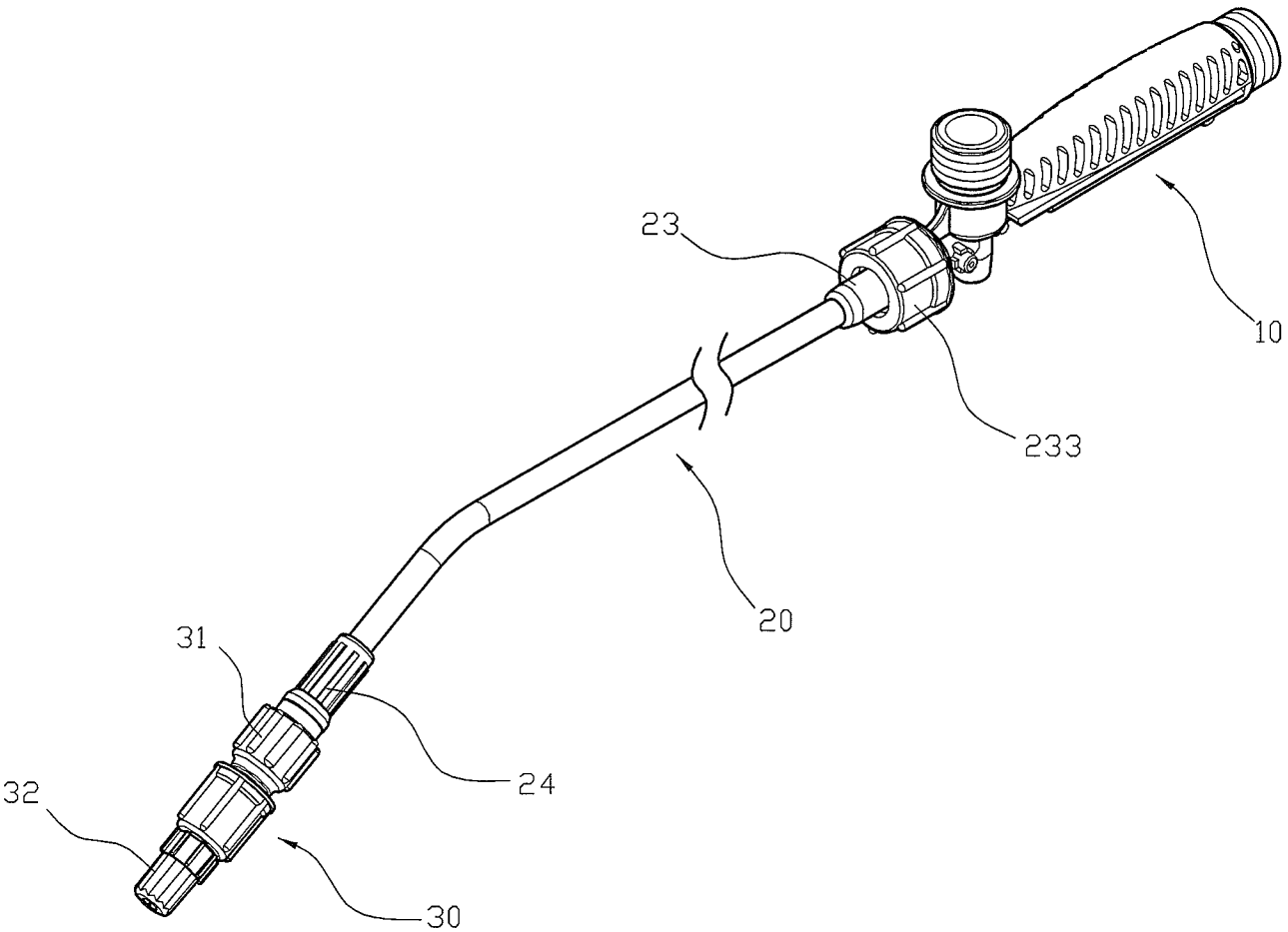
FIG. 1 is a perspective view of a sprayer in accordance with the preferred embodiment of the present invention.
Figure 2:
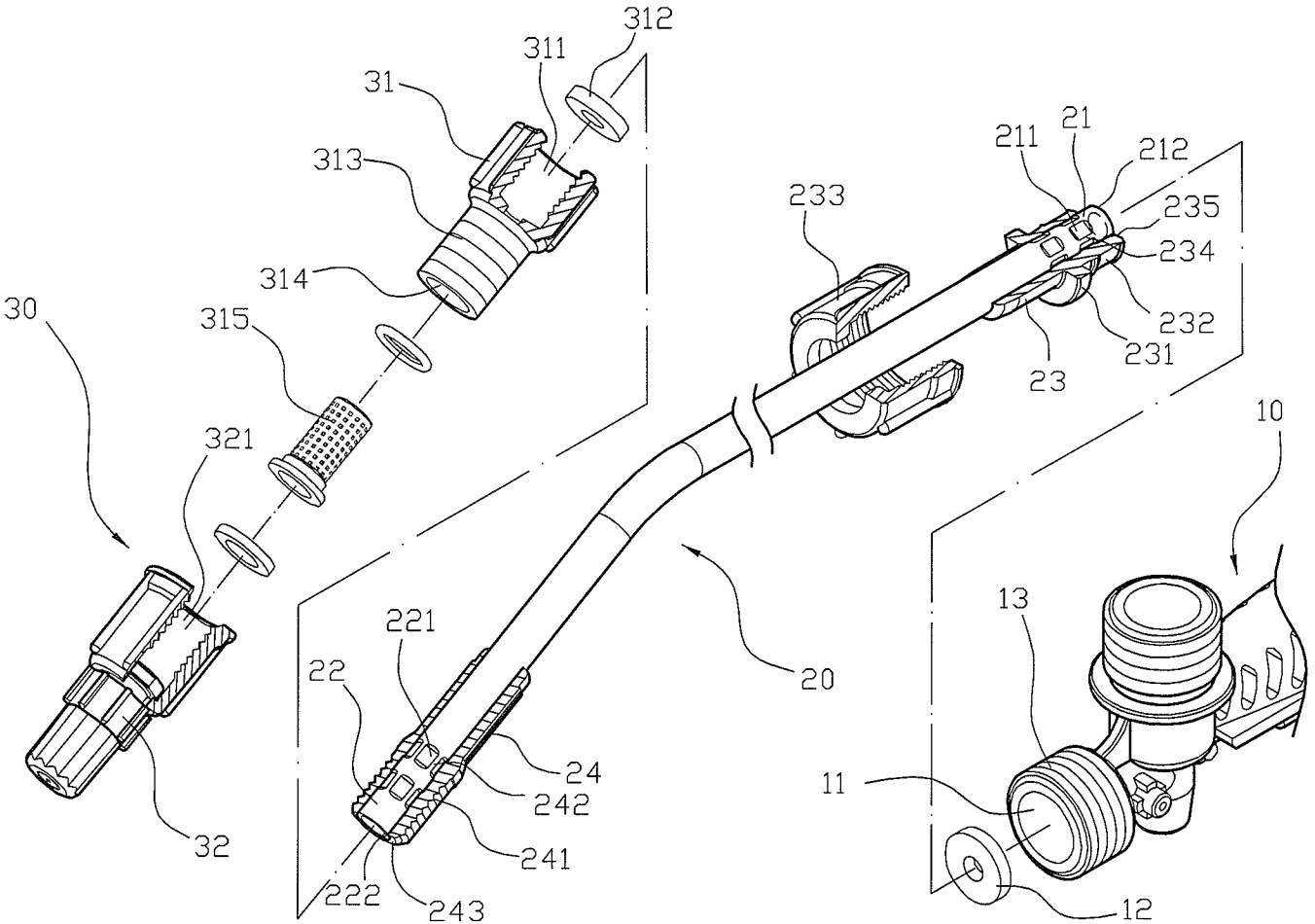
FIG. 2 is an exploded perspective view of the sprayer as shown in FIG. 1.
Figure 3:
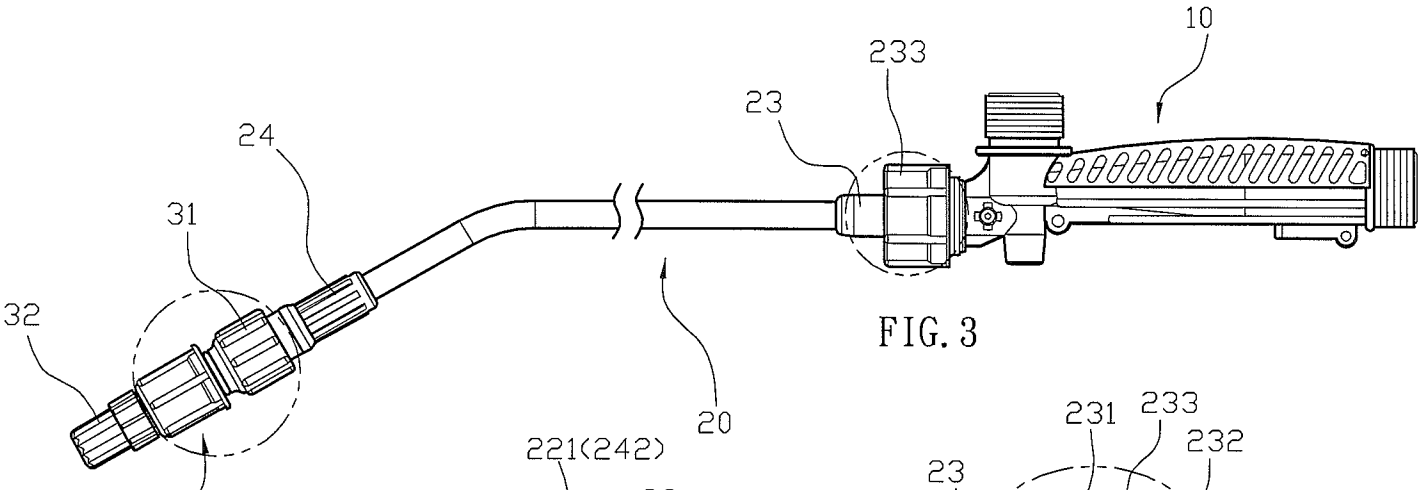
FIG. 3 is a front perspective view of the sprayer as shown in FIG. 1.
Figure 4:
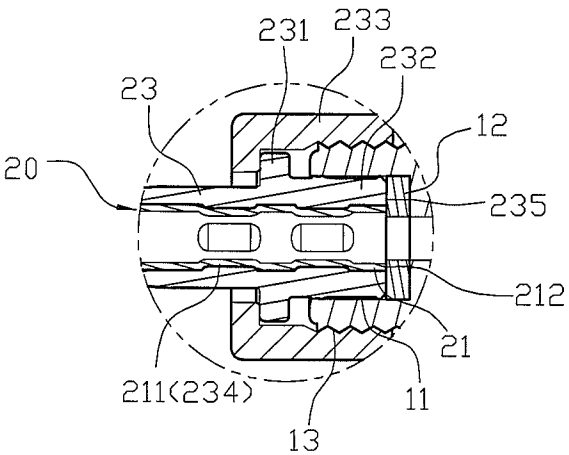
FIG. 4 is a locally enlarged cross-sectional view of the sprayer as shown in FIG. 3.
Figure 5:
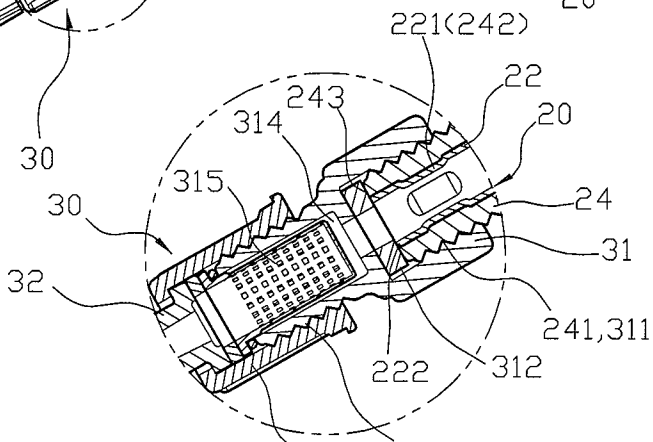
FIG. 5 is a locally enlarged cross-sectional view of the sprayer as shown in FIG. 3.
Figure 6:
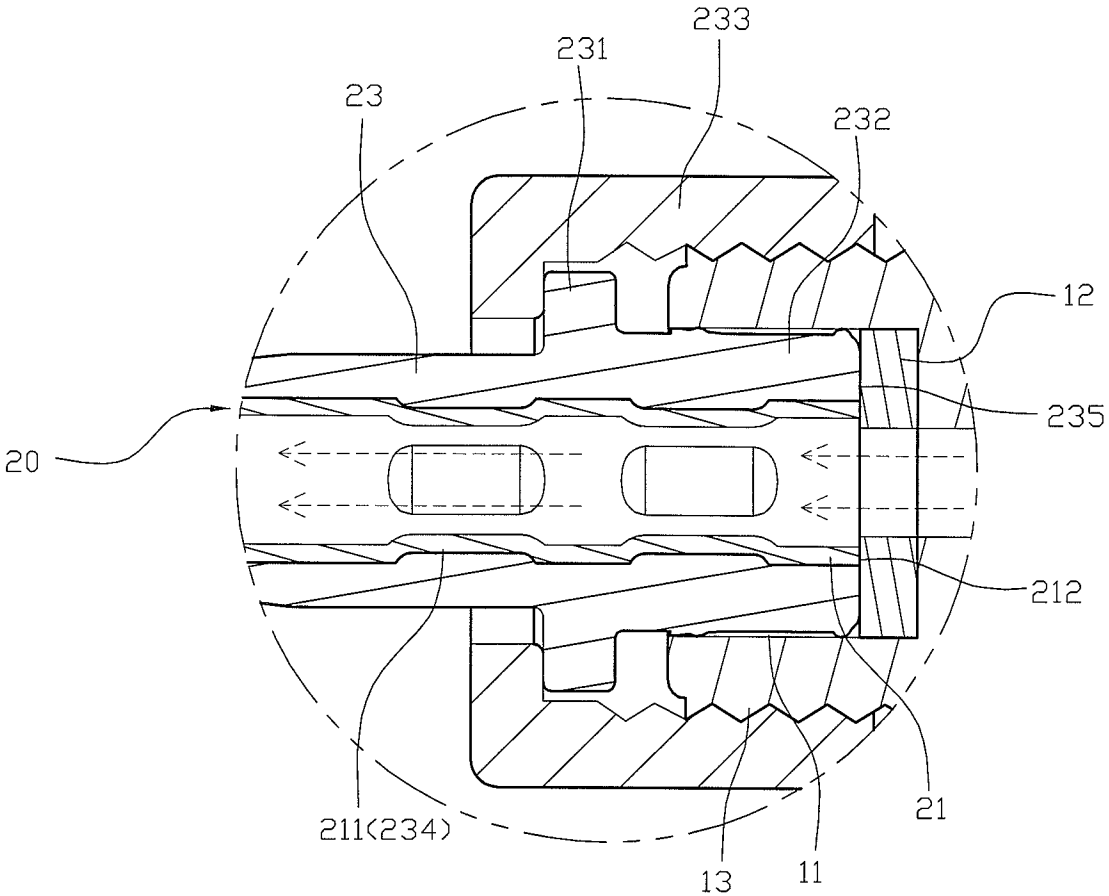
FIG. 6 is a schematic operational view of the sprayer as shown in FIG. 4 in use.

Referring to the drawings and initially to FIGS. 1-6, a sprayer in accordance with the preferred embodiment of the present invention comprises a shank 20 having a first end provided with a first connecting portion 21 and a second end provided with a second connecting portion 22, a first connector 23 secured on the first connecting portion 21 of the shank 20, a second connector 24 secured on the second connecting portion 22 of the shank 20, a handle 10 connected with the first connector 23 by a fastening member 233, and a nozzle assembly 30 connected with the second connector 24.

The handle 10 has an end provided with a threaded fitting portion 13 which has an interior provided with an opening 11 for mounting a first water-tight gasket 12.

The first connector 23 is integrally injection coated on the first connecting portion 21 of the shank 20 so that the first connector 23 presses the first connecting portion 21 of the shank 20 without producing a clearance between the first connector 23 and the first connecting portion 21 of the shank 20. The first connector 23 has a mediate portion provided with a protruding stop flange 231. The first connector 23 has an end provided with an insertion portion 232 inserted into the opening 11 of the threaded fitting portion 13 of the handle 10. The insertion portion 232 of the first connector 23 covers and coats the first connecting portion 21 of the shank 20 completely. The insertion portion 232 of the first connector 23 has an end face 235 flush with an end face 212 of the first connecting portion 21 of the shank 20.

The fastening member 233 is threaded internally and is screwed onto the threaded fitting portion 13 of the handle 10. The fastening member 233 abuts and is stopped by the stop flange 231 of the first connector 23.

The first water-tight gasket 12 is located between the insertion portion 232 of the first connector 23 and the threaded fitting portion 13 of the handle 10. The first water-tight gasket 12 abuts the first connecting portion 21 of the shank 20 and the insertion portion 232 of the first connector 23. Preferably, the first water-tight gasket 12 abuts the end face 212 of the first connecting portion 21 of the shank 20 and the end face 235 of the insertion portion 232 of the first connector 23 to provide a water-tight function.

The second connector 24 is integrally injection coated on the second connecting portion 22 of the shank 20 so that the second connector 24 presses the second connecting portion 22 of the shank 20 without producing a clearance between the second connector 24 and the second connecting portion 22 of the shank 20. The second connector 24 has an end provided with an external threaded portion 241 connected with the nozzle assembly 30. The external threaded portion 241 of the second connector 24 covers and coats the second connecting portion 22 of the shank 20 completely. The external threaded portion 241 of the second connector 24 has an end face 243 flush with an end face 222 of the second connecting portion 22 of the shank 20.

The nozzle assembly 30 includes a mounting member 31 having a first end provided with an internal threaded portion 311 screwed onto the external threaded portion 241 of the second connector 24 and a second end provided with an outer threaded portion 313, a second water-tight gasket 312 mounted in the internal threaded portion 311 of the mounting member 31, a nozzle head 32 having an end an inner threaded portion 321 screwed onto the outer threaded portion 313 of the mounting member 31, and a strainer 315 mounted between the outer threaded portion 313 of the mounting member 31 and the inner threaded portion 321 of the nozzle head 32. The outer threaded portion 313 of the mounting member 31 has an interior provided with a receiving space 314 to receive the strainer 315.

The second water-tight gasket 312 is located between the external threaded portion 241 of the second connector 24 and the internal threaded portion 311 of the mounting member 31. The second water-tight gasket 312 abuts the second connecting portion 22 of the shank 20 and the external threaded portion 241 of the second connector 24. Preferably, the second water-tight gasket 312 abuts the end face 222 of the second connecting portion 22 of the shank 20 and the end face 243 of the external threaded portion 241 of the second connector 24 to provide a water-tight function.

In the preferred embodiment of the present invention, the first connecting portion 21 of the shank 20 has a peripheral wall provided with a plurality of first retaining grooves 211, and the second connecting portion 22 of the shank 20 has a peripheral wall provided with a plurality of second retaining grooves 221. In addition, the first connector 23 has an interior provided with a plurality of first retaining ribs 234 locked in the first retaining grooves 211 of the first connecting portion 21 of the shank 20, and the second connector 24 has an interior provided with a plurality of second retaining ribs 242 locked in the second retaining grooves 221 of the second connecting portion 22 of the shank 20. Preferably, the first retaining ribs 234 of the first connector 23 and the first retaining grooves 211 of the first connecting portion 21 of the shank 20 are formed integrally by injection molding, while the second retaining ribs 242 of the second connector 24 and the second retaining grooves 221 of the second connecting portion 22 of the shank 20 are formed integrally by injection molding.

Figure 7:
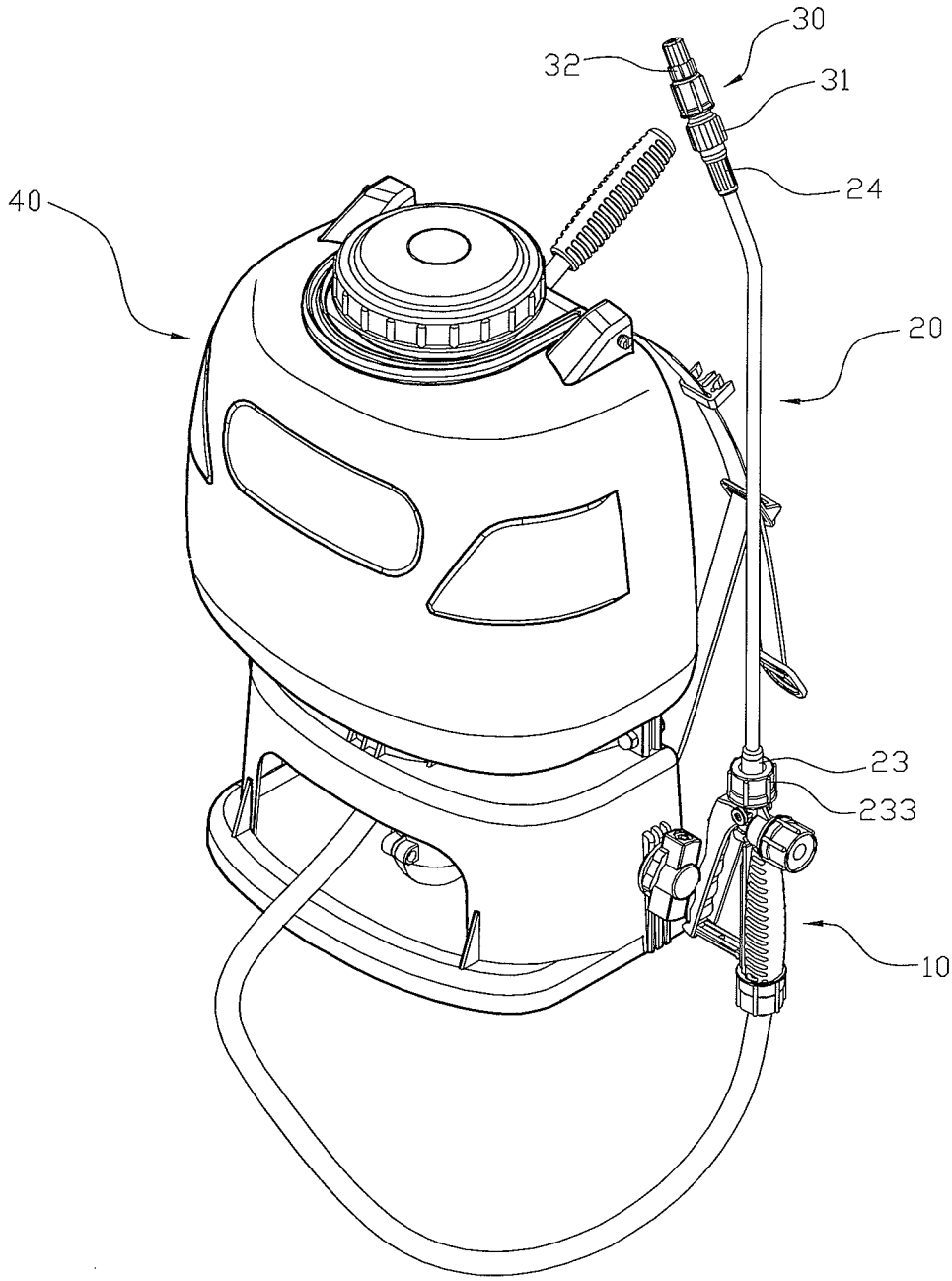
FIG. 7 is a schematic operational view of the sprayer as shown in FIG. 1 in use.
Figure 8:
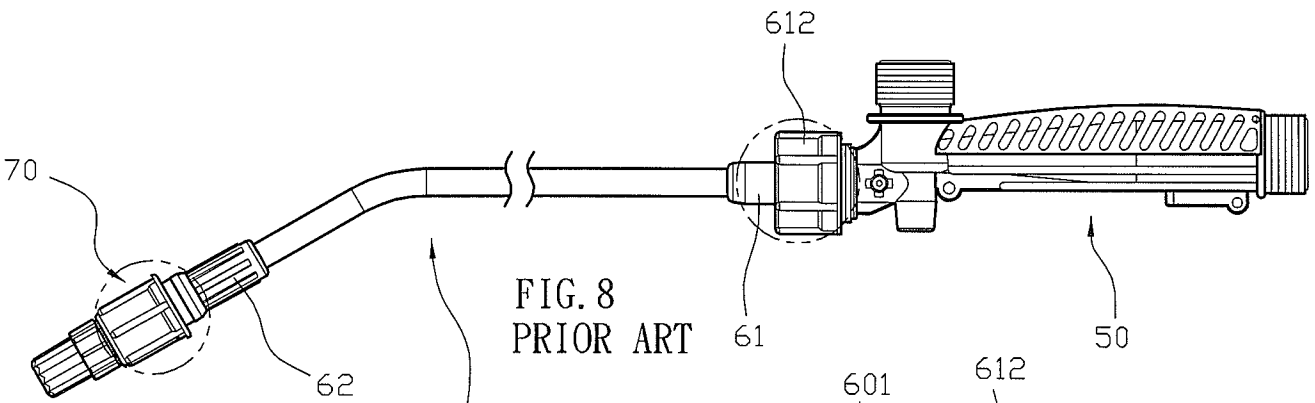
FIG. 8 PRIOR ART
FIG. 8 is a front view of a conventional sprayer in accordance with the prior art.
Figure 10:
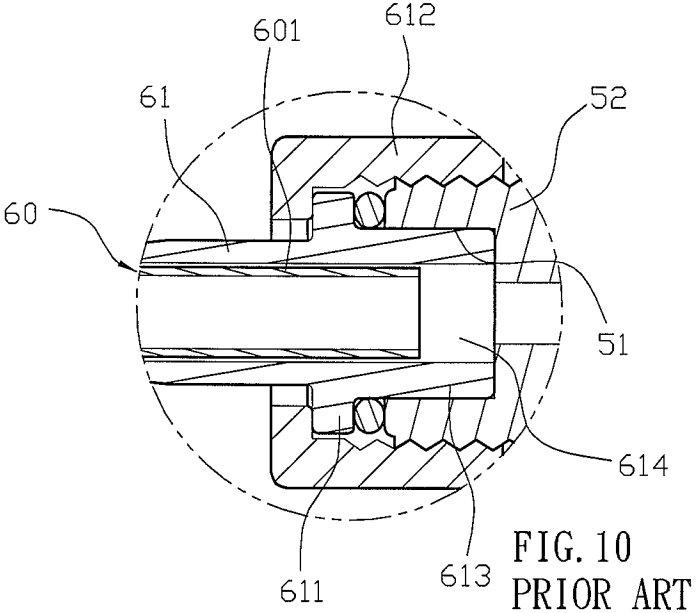
FIG. 10 PRIOR ART
FIG. 10 is a locally enlarged cross-sectional view of the conventional sprayer as shown in FIG. 8.
Figure 11:
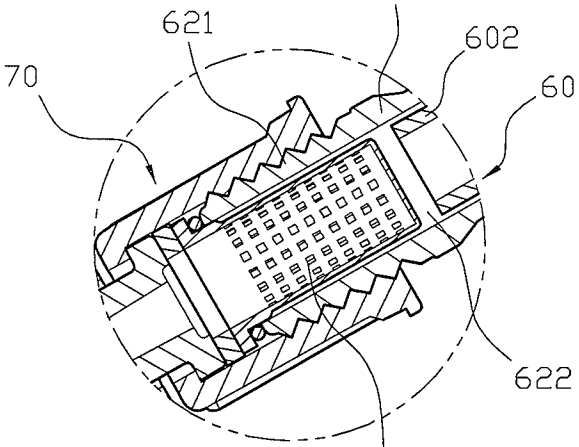
FIG. 11 PRIOR ART
FIG. 11 is a locally enlarged cross-sectional view of the conventional sprayer as shown in FIG. 8.
Figure 9:
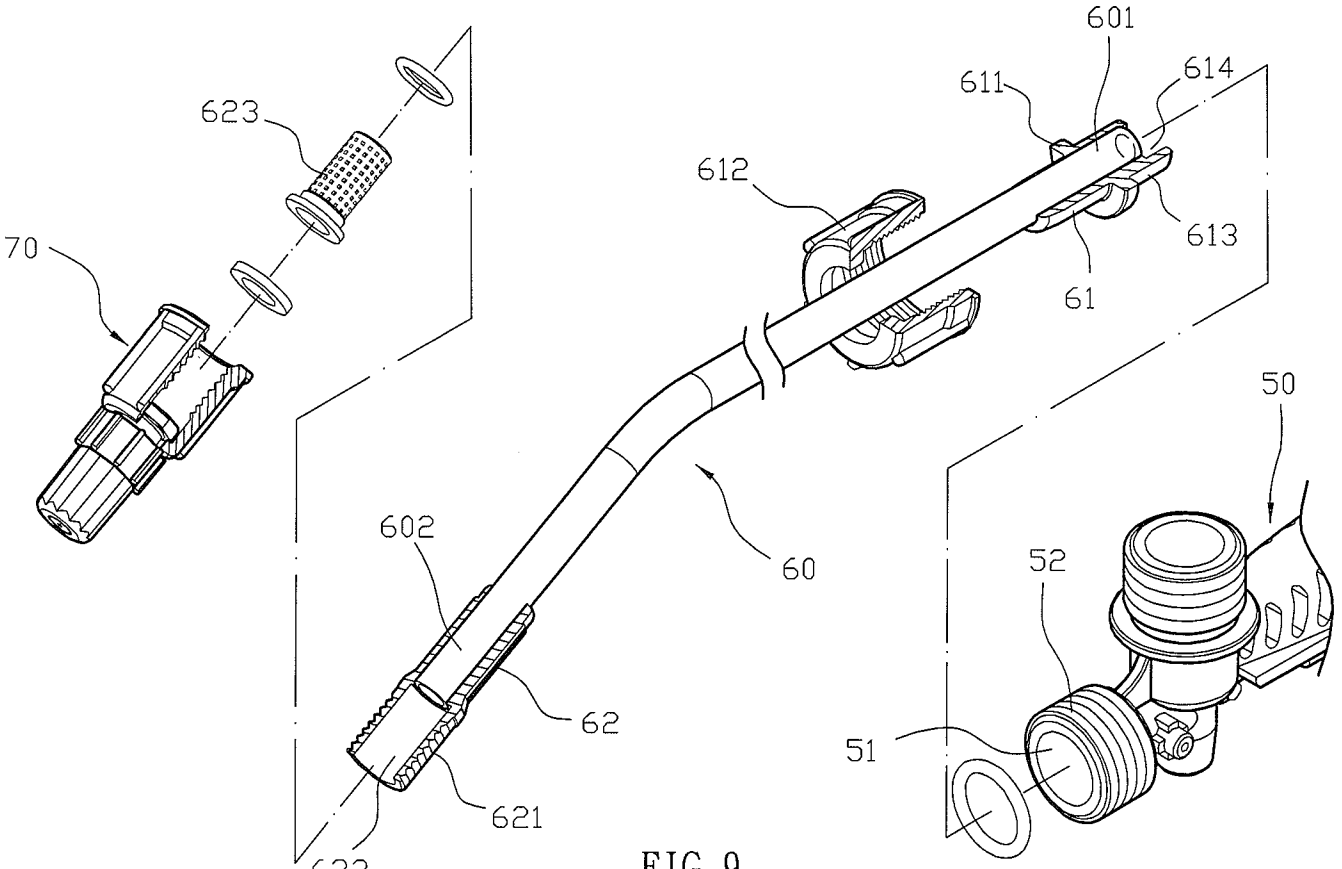
FIG. 9 PRIOR ART
FIG. 9 is an exploded perspective view of the conventional sprayer as shown in FIG. 8.
Figure 12:
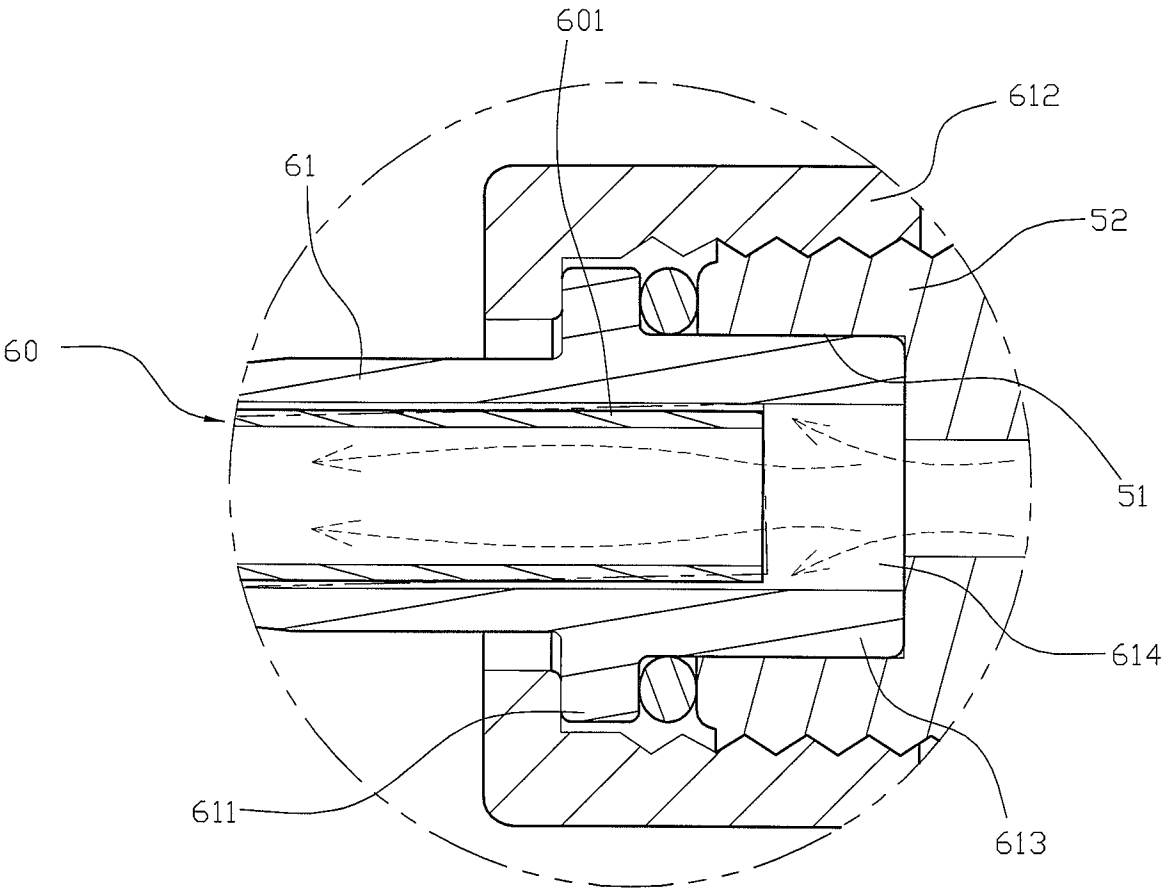
FIG. 12 PRIOR ART
FIG. 12 is a schematic operational view of the conventional sprayer as shown in FIG. 10 in use.
Figure 13:
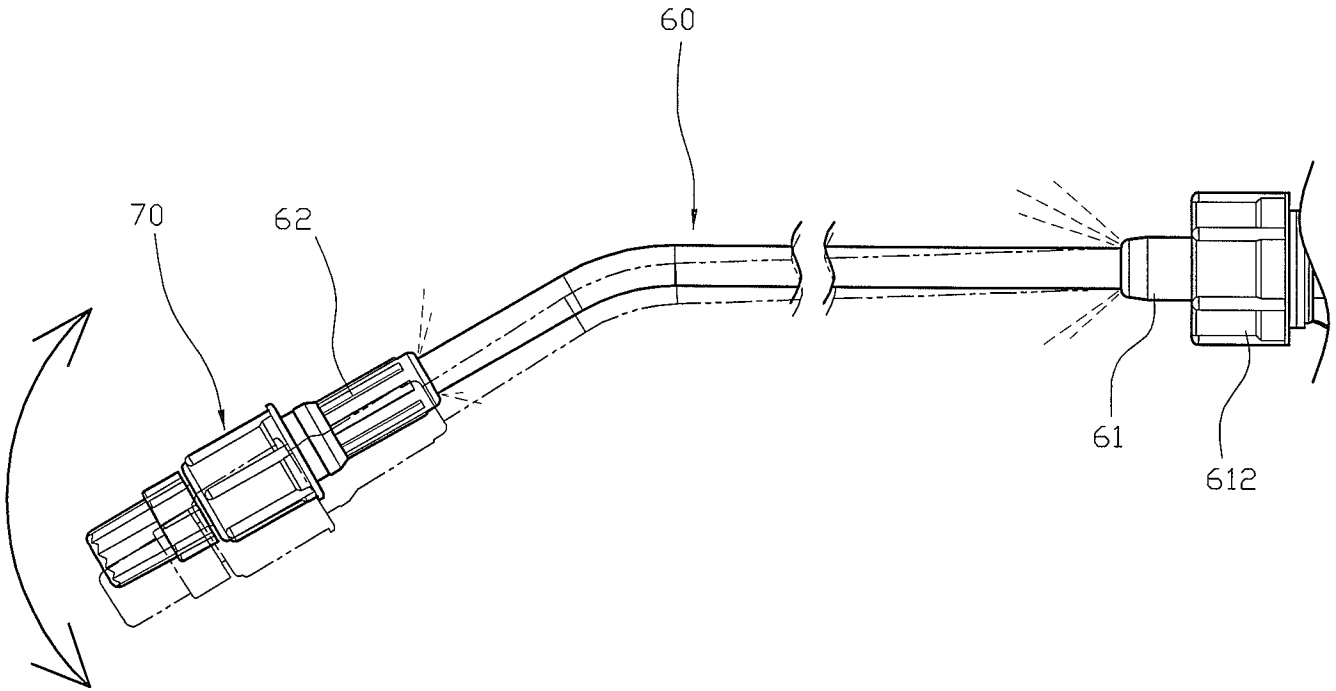
FIG. 13 PRIOR ART
FIG. 13 is a schematic operational view of the conventional sprayer as shown in FIG. 8.

In operation, referring to FIG. 7 with reference to FIGS. 1-6, the handle 10 is connected to a container 40. Thus, the liquid in the container 40 in turn flows through the handle 10 and the shank 20 into the nozzle assembly 30 and is injected outward from the nozzle head 32 of the nozzle assembly 30 for use with a user. At this time, the insertion portion 232 of the first connector 23 covers and coats the first connecting portion 21 of the shank 20 completely so that the liquid directly flows into the first connecting portion 21 of the shank 20 and will not permeate between the insertion portion 232 of the first connector 23 and the first connecting portion 21 of the shank 20. In addition, the first water-tight gasket 12 abuts the end face 212 of the first connecting portion 21 of the shank 20 and the end face 235 of the insertion portion 232 of the first connector 23 to provide a water-tight function so that the liquid will not leak between the insertion portion 232 of the first connector 23 and the first connecting portion 21 of the shank 20 and will not leak between the insertion portion 232 of the first connector 23 and the opening 11 of the threaded fitting portion 13 of the handle 10. At the same time, the external threaded portion 241 of the second connector 24 covers and coats the second connecting portion 22 of the shank 20 completely, and the second water-tight gasket 312 abuts the end face 222 of the second connecting portion 22 of the shank 20 and the end face 243 of the external threaded portion 241 of the second connector 24 to provide a water-tight function so that the liquid will not leak between the external threaded portion 241 of the second connector 24 and the second connecting portion 22 of the shank 20 and will not leak between the external threaded portion 241 of the second connector 24 and the internal threaded portion 311 of the mounting member 31.

Accordingly, the insertion portion 232 of the first connector 23 covers and coats the first connecting portion 21 of the shank 20 completely, and the first water-tight gasket 12 abuts the end face 212 of the first connecting portion 21 of the shank 20 and the end face 235 of the insertion portion 232 of the first connector 23 to provide a water-tight function so that the liquid will not leak between the insertion portion 232 of the first connector 23 and the first connecting portion 21 of the shank 20 so as to enhance the close connection between the first connector 23 and the shank 20. In addition, the external threaded portion 241 of the second connector 24 covers and coats the second connecting portion 22 of the shank 20 completely, and the second water-tight gasket 312 abuts the end face 222 of the second connecting portion 22 of the shank 20 and the end face 243 of the external threaded portion 241 of the second connector 24 to provide a water-tight function so that the liquid will not leak between the external threaded portion 241 of the second connector 24 and the second connecting portion 22 of the shank 20 so as to enhance the close connection between the second connector 24 and the shank 20. Further, the sprayer has a water-tight function so that the sprayer will not leak during a long-term utilization and can be operated safely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A sprayer comprising:

a shank having a first end provided with a first connecting portion and a second end provided with a second connecting portion;

a first connector secured on the first connecting portion of the shank;

a second connector secured on the second connecting portion of the shank;

a handle connected with the first connector; and a nozzle assembly connected with the second connector, wherein:

the handle has an end provided with a threaded fitting portion which has an interior provided with an opening for mounting a first water-tight gasket;

the first connector has an end provided with an insertion portion inserted into the opening of the threaded fitting portion of the handle;

the insertion portion of the first connector covers and coats the first connecting portion of the shank completely;

the second connector has an end provided with an external threaded portion connected with the nozzle assembly;

the external threaded portion of the second connector covers and coats the second connecting portion of the shank completely;

the nozzle assembly includes:

a mounting member having a first end provided with an internal threaded portion screwed onto the external threaded portion of the second connector and a second end provided with an outer threaded portion;

a second water-tight gasket mounted in the internal threaded portion of the mounting member; and a nozzle head having an end an inner threaded portion screwed onto the outer threaded portion of the mounting member;

the first connecting portion of the shank has a peripheral wall provided with a plurality of first retaining grooves;

the second connecting portion of the shank has a peripheral wall provided with a plurality of second retaining grooves;

the first connector has an interior provided with a plurality of first retaining ribs locked in the first retaining grooves of the first connecting portion of the shank; and the second connector has an interior provided with a plurality of second retaining ribs locked in the second retaining grooves of the second connecting portion of the shank.

2. The sprayer of claim 1, wherein the first retaining ribs of the first connector and the first retaining grooves of the first connecting portion of the shank are formed integrally by injection molding.

3. The sprayer of claim 1, wherein the second retaining ribs of the second connector and the second retaining grooves of the second connecting portion of the shank are formed integrally by injection molding.

4. The sprayer of claim 1, wherein:

the insertion portion of the first connector has an end face flush with an end face of the first connecting portion of the shank; and the external threaded portion of the second connector has an end face flush with an end face of the second connecting portion of the shank.

5. The sprayer of claim 4, wherein:

the first water-tight gasket abuts the end face of the first connecting portion of the shank and the end face of the insertion portion of the first connector to provide a water-tight function; and the second water-tight gasket abuts the end face of the second connecting portion of the shank and the end face of the external threaded portion of the second connector to provide a water-tight function.

6. The sprayer of claim 1, wherein:

the first water-tight gasket abuts the first connecting portion of the shank and the insertion portion of the first connector; and the second water-tight gasket abuts the second connecting portion of the shank and the external threaded portion of the second connector.

7. The sprayer of claim 1, wherein:

the first water-tight gasket is located between the insertion portion of the first connector and the threaded fitting portion of the handle; and the second water-tight gasket is located between the external threaded portion of the second connector and the internal threaded portion of the mounting member.

8. The sprayer of claim 1, wherein:

the first connector is integrally injection coated on the first connecting portion of the shank so that the first connector presses the first connecting portion of the shank without producing a clearance between the first connector and the first connecting portion of the shank; and the second connector is integrally injection coated on the second connecting portion of the shank so that the second connector presses the second connecting portion of the shank without producing a clearance between the second connector and the second connecting portion of the shank.

9. The sprayer of claim 1, wherein:

the first connector has a mediate portion provided with a protruding stop flange;

the handle is connected with the first connector by a fastening member;

the fastening member is threaded internally and is screwed onto the threaded fitting portion of the handle;

the fastening member abuts and is stopped by the stop flange of the first connector;

the nozzle assembly further includes a strainer mounted between the outer threaded portion of the mounting member and the inner threaded portion of the nozzle head; and the outer threaded portion of the mounting member has an interior provided with a receiving space to receive the strainer.

* * * * *